US005984212A

United States Patent [19]

Andreae-Jäckering

[11] Patent Number: 5,984,212

[45] Date of Patent: Nov. 16, 1999

[54] METHOD AND APPARATUS FOR PRODUCTION OF EXTREMELY FINE POWDER

[75] Inventor: Michael Andreae-Jäckering, Münster, Germany

[73] Assignee: Altenburger Maschinen Jackering GmbH, Hamm, Germany

[21] Appl. No.: 08/985,535

[22] Filed: Dec. 5, 1997

[51] Int. Cl.[6] ..... B02C 23/20

[52] U.S. Cl. ..... 241/19; 241/21; 241/29; 241/79.1; 241/152.2; 34/329; 34/368; 34/586

[58] Field of Search ..... 241/152.2, 29, 241/5, 39, 21, 18, 19, 79.1; 34/329, 368, 371, 586

[56] References Cited

U.S. PATENT DOCUMENTS

| | | | |
|---|---|---|---|
| 3,797,758 | 3/1974 | Cherdron et al. | 241/29 |
| 4,505,432 | 3/1985 | Koev et al. | 241/29 |
| 4,747,550 | 5/1988 | Jäckering . | |
| 4,852,811 | 8/1989 | Adams et al. | 241/29 |
| 5,096,744 | 3/1992 | Takei et al. . | |
| 5,520,340 | 5/1996 | Krockert et al. | 241/29 |

FOREIGN PATENT DOCUMENTS

| | | |
|---|---|---|
| 226900 | 12/1986 | European Pat. Off. . |
| 406903 | 1/1991 | European Pat. Off. . |
| 3811910 | 10/1989 | Germany . |
| 4200827 | 7/1993 | Germany . |
| 4204600 | 8/1993 | Germany . |
| 29515434 | 1/1996 | Germany . |
| 2132128 | 7/1984 | United Kingdom . |

*Primary Examiner*—Mark Rosenbaum

*Attorney, Agent, or Firm*—Fay, Sharpe, Beall, Fagan, Minnich & McKee LLP

[57] ABSTRACT

A method and apparatus for the manufacture of extremely fine powders, which are ground wet in a mechanical grinder (1) and are subsequently dried. To obtain extremely fine sizes, the powders are ground wet as components of a suspension in the mechanical grinders. An air vortex grinder (4) is used as a dryer to obtain maximum agglomeration-free drying of the powders. The dried powder leaves the drying chamber (5) of the air vortex grinder (4) through an upper product discharge (8) and is fed through a line (9) to a filter cyclone (11). The suspension leaves the mechanical grinder (1) and is blown into the drying chamber (5) of the dryer (4).

16 Claims, 2 Drawing Sheets

METHOD AND APPARATUS FOR PRODUCTION OF EXTREMELY FINE POWDER

BACKGROUND OF THE INVENTION

The invention concerns a process for the manufacture of extremely fine powders, which are ground wet in a mechanical grinder and subsequently dried. In addition, the invention concerns an installation for the execution of said process. Powders of the most diverse kind (for example calcium-carbonate, titanium dioxide, bentonite, dolomite, talcum, pigments, etc.) need to be of increasingly finer granulation size for reasons of application technology. Currently attainable fineness sizes are around 1 $\mu$. In order to attain these fineness sizes, the powders are ground wet as components of a suspension in mechanical grinders (ball mills, bead mills, annular gap mills, etc). After the grinding, during the wet phase, the powders need to be dried. Spray dryers can be used for this purpose.

During the drying phase, re-agglomerates frequently develop in the spray dryer. These must subsequently be sifted out and the powders must be once again ground wet in order to restore the original fineness, as well as dried and sifted.

SUMMARY OF THE INVENTION

It is the object of the present invention to add a drying phase to the process of making fine powders which makes possible agglomerate-free drying of the extremely fine powders.

According to one aspect of the invention, drying of the ground powders in a suspension takes place in an air vortex grinder.

With grinders of this type described, for example, in EP-B1-226 900, the reduction principle is based in that the ground stock particles are accelerated within a multitude of air vortexes, generated by rotating plates, to high velocity and predominantly perform reciprocal thrusts. Due to the circumstance that the stock is constantly held within turbulent air currents, the moisture adhering to the particles can be absorbed very rapidly by the air and quick and intensive drying can thus be attained. Additionally, the reduction effect is retained, so that re-agglomerates will not develop. In comparison to the traditional drying of extremely fine powders in spray dryers, which requires several successive steps: sifting, wet subsequent grinding as well as renewed drying and sifting. According to one aspect of the present invention, agglomerate-free drying of the powders can be attained in one single process step. It is appropriate to supply hot air as a carrier gas to the air vortex grinder used as a dryer and/or to directly pump the suspension into the grinding chamber via a nozzle entry. The result is an acceleration in drying.

According to another aspect of the present invention, the agglomerate-free drying can be combined with surface treatment of the powders. This can be done, for example, in such manner that the surface treatment agent is introduced together with the carrier air. This can also be done by spraying the treatment agent via a nozzle into the grinding chamber of the grinder.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
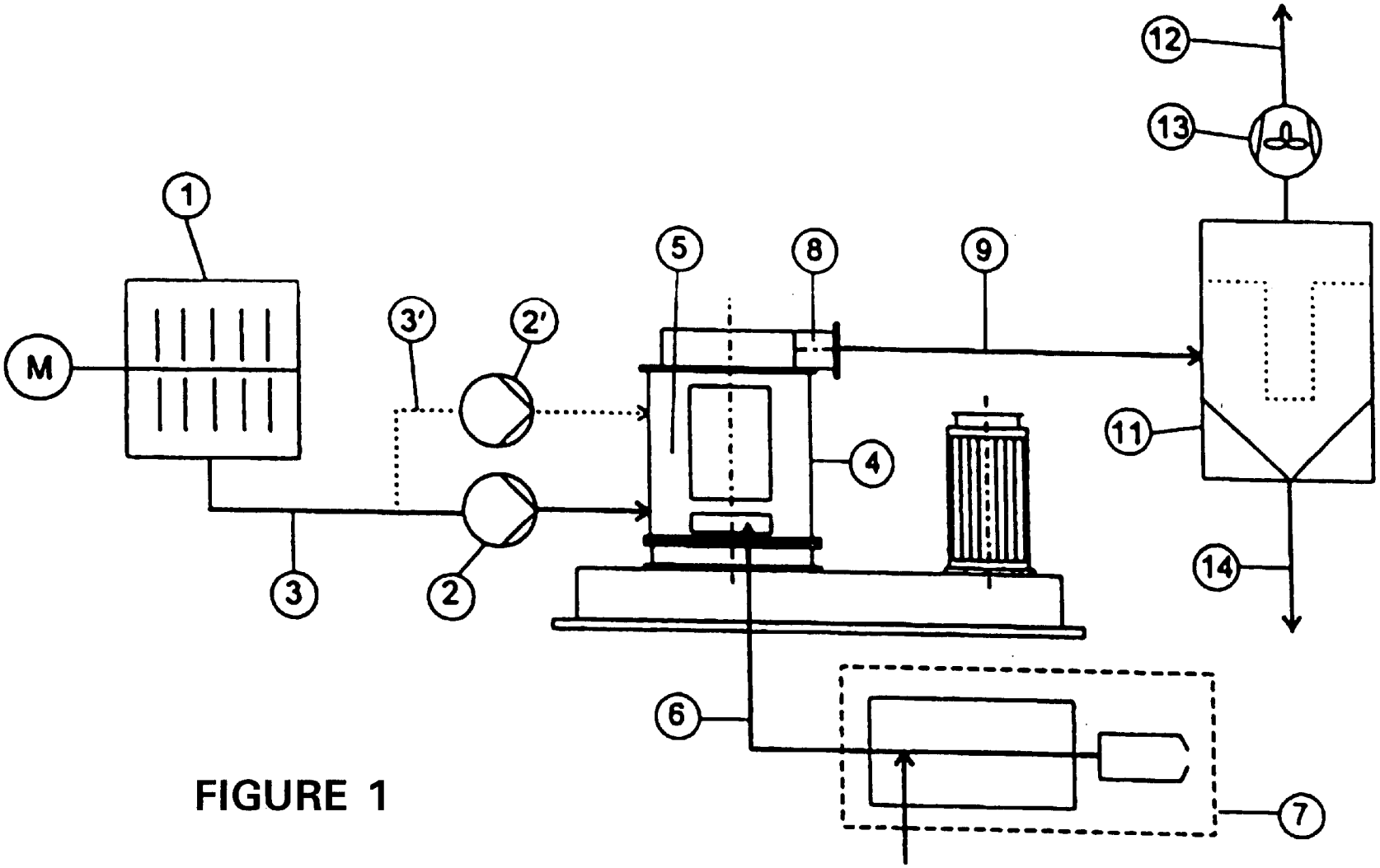
FIG. 1 is a schematic of a method of production of extremely fine powders according to one aspect of the present invention.
Figure 2:
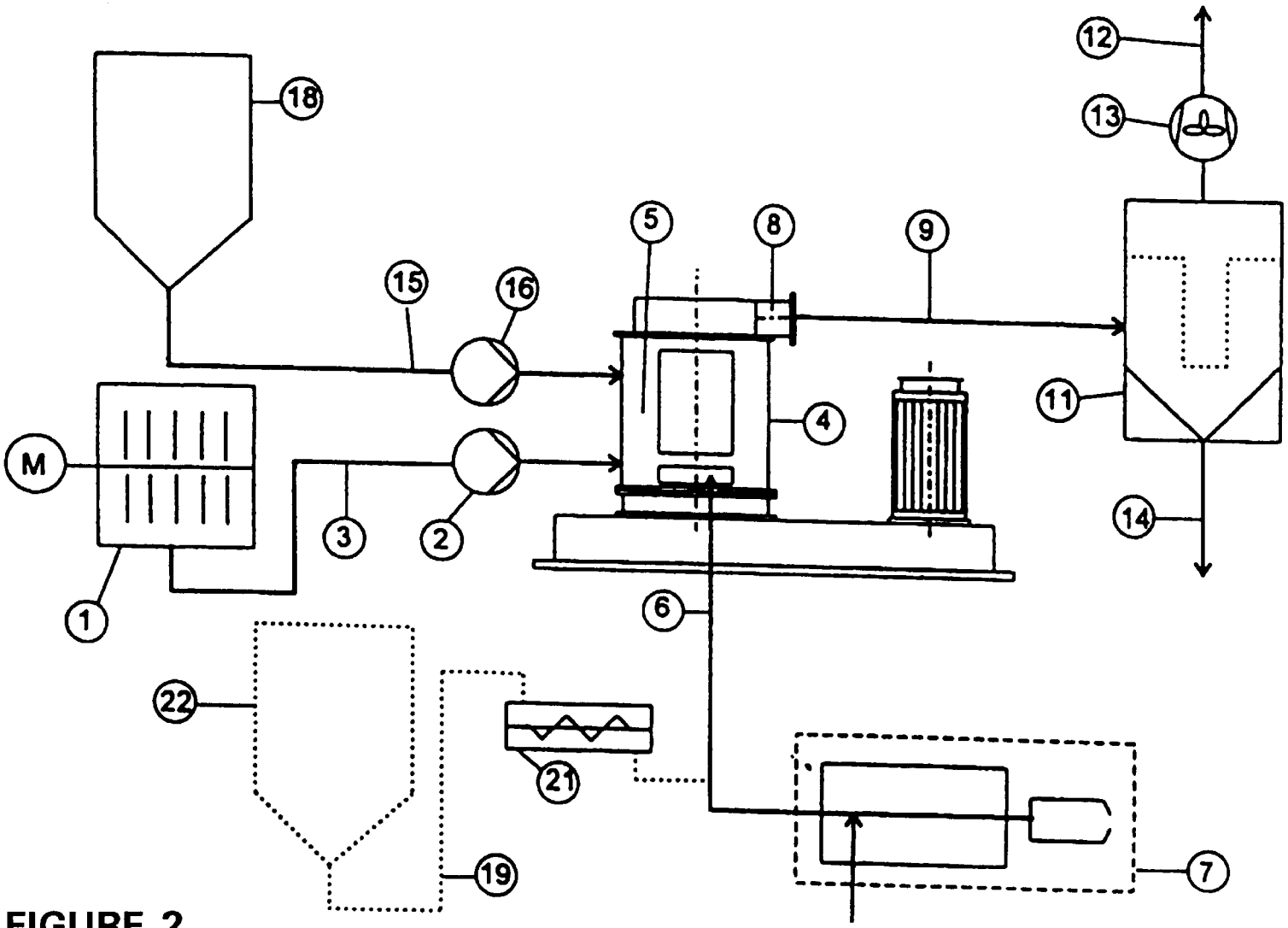
FIG. 2 is a schematic of a method of production of extremely fine powders according to another aspect of the present invention.

In both FIGS. 1 and 2, the schematically illustrated mechanical grinder 1, in which the wet-grinding of the powder takes place, is shown. Wet powder as a component of a suspension is ground in the mechanical grinder 1. With the aid of a hose- or mono-pump 2, the powder is continuously transported through line 3 to the air vortex grinder 4, which serves as a dryer, and blown, by means of a nozzle (not shown), into the grinding or drying chamber 5. The drying chamber 5 is supplied with air from below through line 6 by a hot air generator 7.

The dried powder leaves the air vortex grinder 4 via an upper product discharge 8 and is fed through line 9 into a commercially available filter cyclone 11, in which air is separated from the dried powder.

The air leaves the cyclone 11 through line 12 and ventilator 13. The powder exits through the product discharge 14.

Referring again to FIG. 1, the suspension leaving the mechanical grinder 1 can be blown at various locations into the drying chamber 5 of the dryer 4. Nozzles can be added at the end of line 3 with pump 2 at varying heights. By way of example, line 3' with pump 2' is represented in dotted lines, ending in the upper region of the drying chamber 5. Selection of the location for nozzle-injection into the drying chamber 5 depends upon the properties of the powder and/or upon the desired dwelling time in dryer 4.

In the specific embodiment according to FIG. 2, line 3 with pump 2 enters into the lower region of the drying chamber 5 of the dryer 4. In the upper region, a line 15 with pump 16 enters the drying chamber 5 preferably through a nozzle (not shown). The line 15 is connected to the reservoir 18. Reservoir 18 contains a surface treatment product for the wet powder. An alternative arrangement is indicated by dotted lines, in which the surface treatment agent, preferably in form of powder, is introduced into the air intake of the dryer 4. For that purpose, line 19 with blower 21, which are connected to a reservoir 22 holding the substance, are provided to supply air to the drying chamber 5 through line 6.

During operation, the drying chamber 5 of dryer 4 is supplied with either hot air through pipe 6 or the powder in suspension through pipe 3 or 3'. Drying takes place quickly, gently and agglomeration-free within the multitude of generated air whirls, to residual moistures, for example, of 0.5% and below. The dried powder and the air leave the drying apparatus 4 via discharge 8 and are separated from each other in cyclone 11.

Referring again to FIG. 2, if surface treatment (coating) is desired at the same time, a liquid coating substance can be injected in the upper area of the drying chamber 5. Powder which as been injected into the lower area is already dry, so that any moisture adhering to the powder will not interfere with the desired coating. In the event that moisture adhering to the powder might interfere with the coating process, a treatment substance can also be introduced into the hot air current through line 6. Dry surface treatment substances can also be introduced into the air intake nozzle of dryer 4 for a similar purpose.

The following powders ground with water into grain sizes ranging between 1 and 50$\mu$, were dried in a test facility:

| Product | Dry Substance Entry | Dry Substance Final Product |
|---|---|---|
| Calcium Carbonate | 50–65% | 99.6% |
| Magnetic Slurry | 30–35% | 99.5% |
| Chromium oxide | 40–45% | 99.6% |
| Pigments | 25–30% | 99.5% |
| Iron Oxide | 32–38% | 99.8% |
| Ceolite | 60% | 95% |

The products flow through the grinder within a few milliseconds and are exposed and are exposed to the hot air current which is being whirled about through the grinder. The water spontaneously evaporates without the products having a chance for re-agglomeration. Typical entry temperatures lie between 200° C. and 400° C., in some special cases up to 500° C. The typical exit temperatures of the grinding mill lie between 70° C. and 110° C. In a very short period of time a temperature drop is reached exceeding 300° C.

Product coating can for example be done with steareate in powder form or with liquid stearic acid. Stearate is preferably dosed into the hot air intake, stearic into the drying chamber 5 (see FIG. 2). Successful tests were run with calcium carbonate and lime (initial dry substance approximately 60% respectively), and also with pigments and hydrated lime (initial dry substance approximately 30% respectively).

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

I claim:

1. A method for drying extremely fine powders which are ground wet in a mechanical mill to produce a slurry of liquid and particles in a 1–50$\mu$ range, the method comprising:

with an air vortex grinder concurrently gently agitating the particles to prevent agglomeration while separating the liquid and discharging the powder of particles still in the 1–50$\mu$ range in suspension in air with a residual moisture below 0.5%.

2. A method for manufacturing extremely fine powders with a 1–50$\mu$ particle size without agglomeration, the method comprising:

grinding wet powder in a mechanical mill to a preselected extremely fine particle size;

drying the extremely fine wet powder in a suspension in an air vortex grinder; and introducing a surface treatment agent in the form of powder into an air intake of the air vortex grinder to surface treat the fine particulate powder concurrently with drying.

3. The method according to claim 2, wherein the air vortex grinder is supplied with hot air as a carrier gas.

4. The method according to claim 2, wherein the suspension with the wet powder is injected into a grinding area or a drying chamber of the air vortex grinder.

5. The method according to claim 4, further including injecting a liquid surface treatment agent into the drying chamber of the air vortex grinder.

6. The method according to claim 5, further including introducing the suspension with the wet powder into a lower area of the drying chamber and flowing an air current from the lower area to an upper area of the drying chamber, and introducing the surface treatment agent into an upper area of the drying chamber.

7. A method of producing extremely fine powders with particles in the 1–50 micron range, the method comprising:

grinding a mixture of water and coarse material into a wet slurry of water and particles in the 1–50 micron range;

removing the water from the slurry to leave a non-agglomerated powder of the 1–50 micron range particles, the water removing step including:

feeding the slurry into a vortex grinder;

whirling the particles and water in hot air to form a vortex to evaporate the water and discharge (i) air and water via a first port and (ii) air and the fine powder with residual moisture below 0.5% from a second port, the whirling quickly and gently preventing agglomeration of the fine particles;

separating the particles from the air discharged from the second port to produce the fine powder.

8. The method according to claim 7 wherein the particle size is below 2 microns.

9. The method according to claim 7 wherein the vortex grinder is only capable of grinding particles down to a size which is greater than the particle range, whereby the vortex grinder dries without reducing the particle size.

10. The method according to claim 7 wherein entry temperatures of the hot air are between 200° and 500° C. and the exit temperatures are between 70° and 110° C.

11. A system for the manufacture of extremely fine powders with particles in the 1–50$\mu$ range, the system comprising:

a mechanical mill for grinding the powder wet to produce a slurry of particles in the 1–50$\mu$ range suspended in liquid;

an air vortex grinder which receives the wet slurry from the mechanical mill and removes the liquid while gently agitating the particles to prevent agglomeration to produce the extremely fine powder with nonagglomerated particles still in the 1–50$\mu$ range entrained in air with residual moisture of less than 0.5%; and a filter for separating the extremely fine powder from the air.

12. A system for the manufacture of extremely fine powders comprising:

a mechanical mill for grinding the powder wet;

an air vortex grinder which receives the wet powder from the mechanical mill and dries the wet powder; and a filter cyclone located downstream from a product discharge outlet of the air vortex grinder to separate air from the dried powder.

13. The system according to claim 12, wherein a discharge outlet of the mechanical mill is connected with one of a grinding chamber and a drying chamber of the air vortex grinder through a pump via a pipe.

14. The system according to claim 13, wherein an end of the pipe enters the drying chamber and includes a nozzle.

15. The system according to claim 12, further including a line which is connected with a reservoir for a liquid surface treatment substance and a drying chamber of the air vortex grinder.

16. The system according to claim 12, further including a line which is connected with a reservoir for a powdery surface treatment substance and an air intake of the air vortex grinder.

* * * * *